US005609351A

United States Patent [19]

Vermillion

[11] Patent Number: 5,609,351

[45] Date of Patent: Mar. 11, 1997

[54] SNOW BOARD INSERT WITH HEXAGONAL BASE

[76] Inventor: James H. Vermillion, 2025 W. Century Way, Boise, Id. 83709

[21] Appl. No.: 343,783

[22] Filed: Nov. 22, 1994

Related U.S. Application Data

[63] Continuation-in-part of Ser. No. 27,632, Aug. 25, 1994.

[51] Int. Cl.[6] ..... A63C 11/00

[52] U.S. Cl. ..... 280/611; 411/180; 280/14.2

[58] Field of Search ..... 280/611, 14.2, 280/601; 411/180, 82, 258, 930, 908

[56] References Cited

U.S. PATENT DOCUMENTS

| | | | |
|---|---|---|---|
| 3,722,565 | 3/1973 | Miller, Jr. et al. | 411/180 |
| 4,747,613 | 5/1988 | Brichoud et al. | 280/611 |
| 4,871,186 | 10/1989 | Klosterman | 280/611 |
| 5,244,326 | 9/1993 | Henrikson | 411/180 |
| 5,391,031 | 2/1995 | Medal | 411/180 |

FOREIGN PATENT DOCUMENTS

| | | | |
|---|---|---|---|
| 2431868 | 3/1980 | France | 280/611 |

*Primary Examiner*—Richard M. Camby
*Attorney, Agent, or Firm*—Ken J. Pedersen; Barb S. Pedersen

[57] ABSTRACT

Embodiments of an insert are shown and described, each insert being for use with recreational boards, such as snow boards, to attach bindings or other equipment onto the board. Each insert is imbedded into the board, by being inserted and cemented into a two-diameter hole drilled in the board from the bottom. Each insert includes a generally cylindrical shaft extending up through the narrow portion of the hole to the top surface of the board, for receiving screws or bolts into the threaded interior space of the insert. Each insert embodiment includes a non-round base having an outer perimeter edge that is not a circle in shape. The preferable hexagonal base and the preferably U-shaped channels on the exterior surface of the shaft prevent the insert from breaking loose from the cement and rotating.

11 Claims, 3 Drawing Sheets

SNOW BOARD INSERT WITH HEXAGONAL BASE

DESCRIPTION

This application is a continuation-in-part of my prior application Ser. No. 29/027,632, filed Aug. 25, 1994, pending and entitled "Insert With Hexagonal Base", the disclosure of which is hereby incorporated by reference.

BACKGROUND OF THE INVENTION

1. Field of the Invention

This invention relates generally to snow boards and snow board bindings. More specifically, this invention relates to the threaded inserts that are cemented in the holes bored into snow boards for securing bindings to the boards.

2. Related Art

Snow boarding is a sport that is fast-growing in popularity. The snow board is broader and shorter than a ski and is typically made of a wood core wrapped in fiberglass. The tips, tails and top of the board are typically covered in ABS plastic, and the edges are typically carbon steel. The snow board bottom, or base, is covered with P-Tex™.

A snow board is typically used with the snow boarder's feet held by two bindings on a single board. The bindings are of many designs, but usually include bottom flanges or brackets that extend out from both sides of the binding and are screwed or bolted onto the snow board. The screws or bolts are screwed into metal inserts that are imbedded in the board.

A standard insert is rivet-shaped piece, with a cylindrical-shaped shaft, which has a threaded hollow interior, and a round base, which has a circular outer perimeter edge. Some standard inserts have texture on the exterior surface of the shaft.

During manufacture of the board, the standard insert is pushed up into a two-diameter hole bored through the board from the bottom to the top. The cylindrical-shaped shaft extends up into the smaller-diameter portion of the hole, reaching up about flush with, or slightly below, the top surface of the snow board, so that the threaded interior surface can receive the binding screws. The round base rests in the larger-diameter portion of the hole. Cement, epoxy, adhesive, or other filler is poured into the hole around the insert to secure it in place and to fill the hole, and P-Tex™ is applied over the hole on the bottom of the snow board to create a smooth snow board base.

These standard inserts are typically installed in 8–16 holes, which lie in various arrangements on the snow board to accept different types of bindings and to allow for adjustment in the position of the bindings on the board. The plurality of holes and inserts allows the user to set up the binding positions for his/her stature, snow boarding style, and ability.

The insert base is a circular flange that provides an anchor to prevent the insert from being pulled out of the hole by the forces on the bindings. The diameter of the base typically is about 1.75–2.5 times the diameter of the cylindrical shaft. This base diameter provides a large surface area ledge that abuts up against the portion of the snow board that surrounds the smaller-diameter portion of the hole. Because typically more than half of the thickness of the snow board lies above the insert base, the base, and consequently the whole insert, is held securely in the hole.

The standard inserts do tend, however, to become loose and rotate inside the holes. Over-tightening of the binding screws, or just the repeated torque on the inserts from adjustment and use, can break the inserts loose from the cement. The inserts then can rotate in the holes, making installation or removal of the bindings difficult, if not impossible.

What is needed is an improved method of securing bindings to snow boards. What is needed is an improved system that may be installed during manufacture of snow boards or that may be retrofit into snow boards that are already in use.

SUMMARY OF THE INVENTION

An object of the present invention is to provide an improved means for connecting bindings to snow boards. Another object is to provide an inexpensive, effective connection device that may be easily retrofit into existing boards, without damage to the board, without compromising the strength of the board, and without expensive and difficult procedures.

The present invention is an improved snow board insert that has a non-round base, or, in other words, a base that has a non-circular outer perimeter edge. This non-round base keeps the insert securely anchored in the cement and hole of the snow board, preventing the insert from rotating in the hole. The non-round base features an outer edge that has corners or segments that tend to catch or gouge into the cement or to push against the cement. This contrasts with the standard insert base, which has a smooth circular outer edge that slips along the cement to allow the insert to rotate. The preferred non-round base is a hexagonal base, with six corners and six flat segments that keep the insert anchored in the cement even when significant and repeated stresses are placed on the insert.

DETAILED DESCRIPTION OF THE PREFERRED EMBODIMENT.

Figure 1:
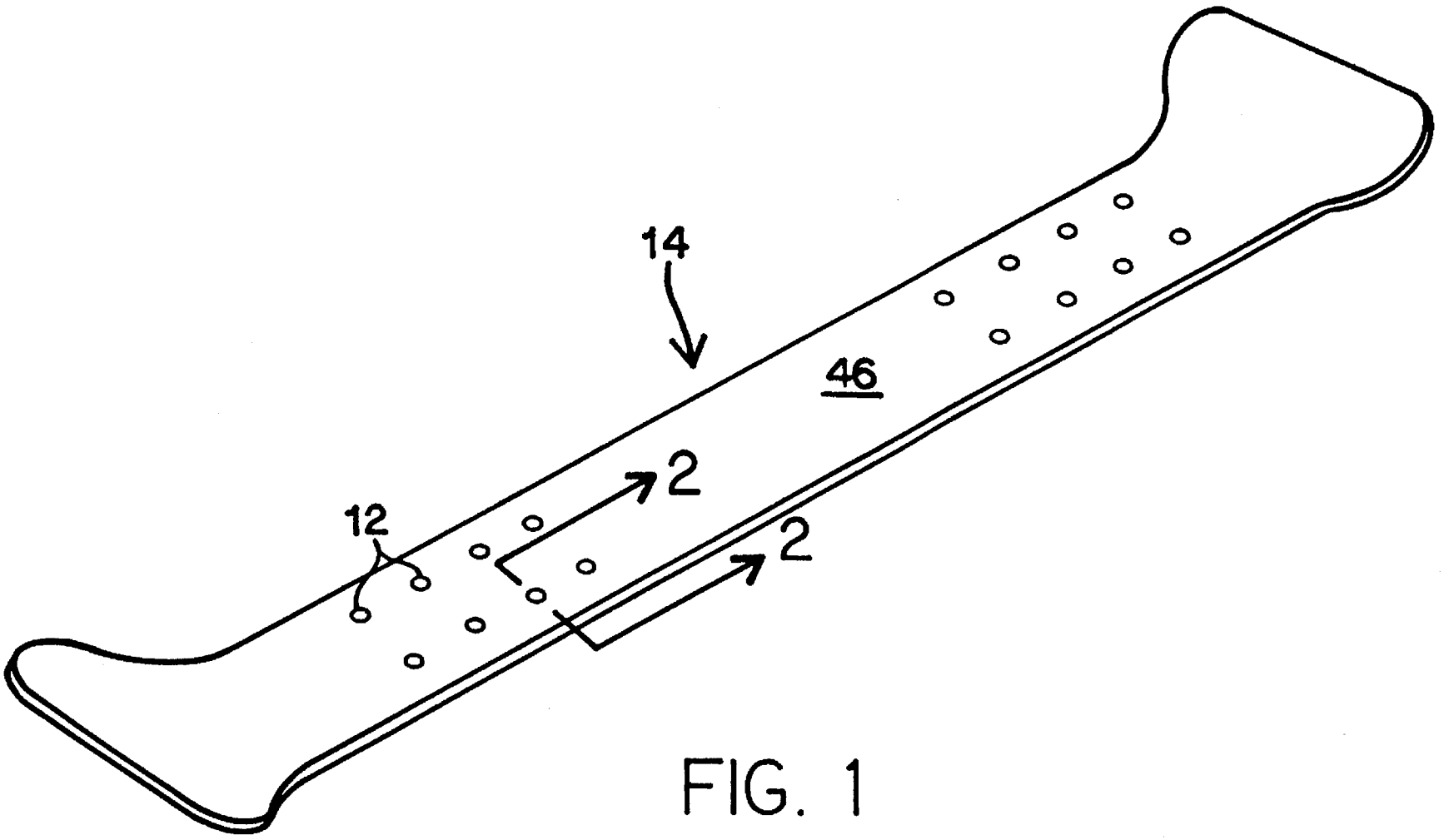
FIG. 1 is a perspective view of snow board, showing sixteen holes for binding attachment.

Referring to FIGS. 2–8, there is shown one, but not the only, embodiment of the invented insert with non-round base 10. The insert 10 is for placement into the holes 12 of a snow board 14, such as is illustrated in FIG. 1.

The insert 10 has a hollow cylindrical shaft 16 with an threaded interior surface 18 defining an interior space 20. The threads 22 and interior space 20 receive the screws or bolts of the bindings (not shown) to hold the bindings on the board 14.

The exterior surface 28 of the shaft 16 has a knurled texture for gripping the cement 30, or other filler, that fills the hole 12. The knurling may be any texture designed to improve grip of the exterior surface 28. Preferably, the knurling is a plurality of vertical, U-shaped channels 32 cut into the exterior surface 28 creating sharp edges 34 around each channel 32. The combination of cement 30 extending into the U-shaped channels 32 and the sharp edges 34 gripping into the cement 30, helps prevent the insert 10 from rotating in the cement 30 and hole 12.

The insert 10 has a non-round base 36 with extends out perpendicularly from the shaft 16. The base 36 is generally planar, which may optionally include base designs with texture or protrusions, as long as the texture or protrusions do not extend so far that they would extend beyond the bottom surface 44 of the board 14. The preferred base 36 has a hexagonal shape, with six corners 38 and six flat segments 40. The diameter of the base 36 is preferably 0.75 inches across the corners and the shaft 16 diameter ranges from about 0.2–0.4 inches, depending on the application. The shaft 16 preferably is about 7–10 mm (0.28–0.4 inches) high. The exact dimensions of the insert 10 may vary to fit various snow boards and binding screws from various manufacturers. The insert 10 design makes a top ledge 42 with a large surface area to abut up against the snow board 14 when the insert 10 is installed.

Figure 2A:
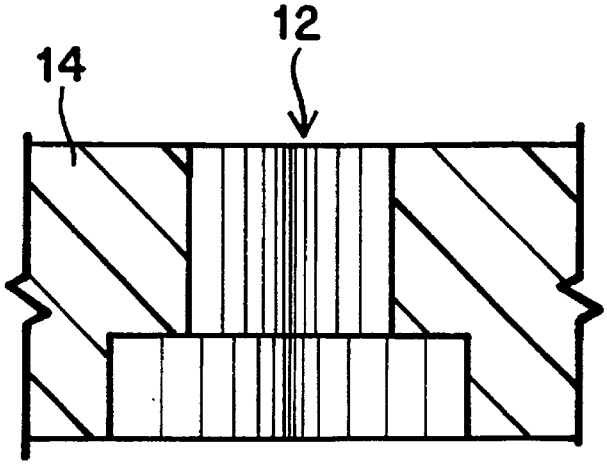
FIG. 2A is a cross-sectional view of a hole in a portion of the snow board of FIG. 1, viewed along the lines 2—2 in FIG. 1.
Figure 2B:
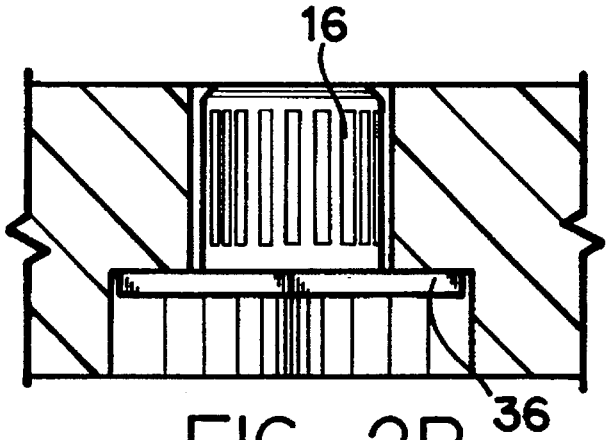
FIG. 2B is a cross-sectional view of the hole in FIG. 2A, with one embodiment of the invented insert placed in the hole.
Figure 2C:
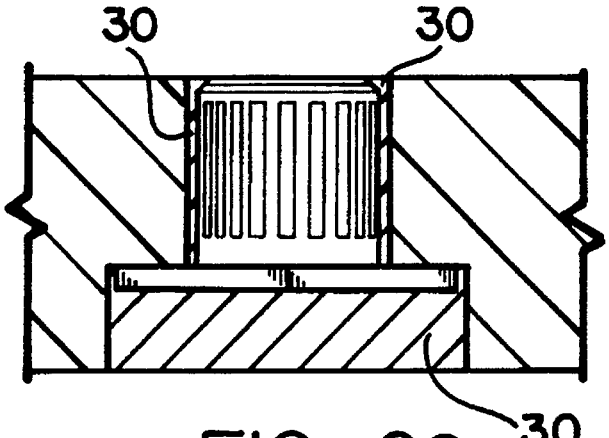
FIG. 2C is a view of the hole and insert embodiment of FIG. 2B, with cement added to secure the insert.
Figure 3:
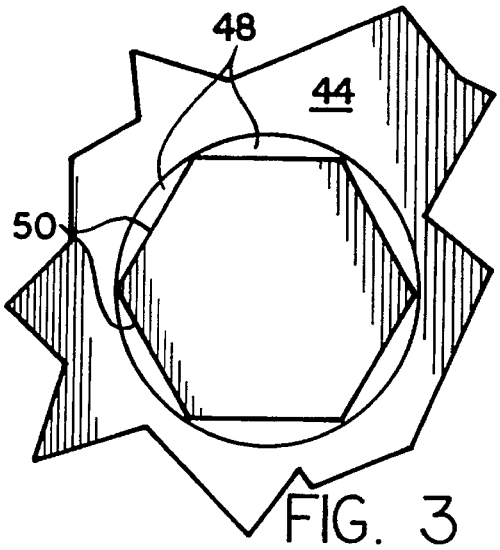
FIG. 3 is bottom view of a portion of the snow board of FIG. 1 together with the embodiment of the insert of FIG. 2B inserted into the hole.
Figure 4:
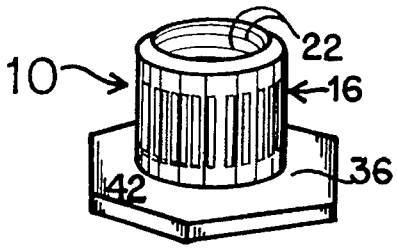
FIG. 4 is a perspective view of the embodiment of the invented insert of FIG. 2B.
Figure 5:
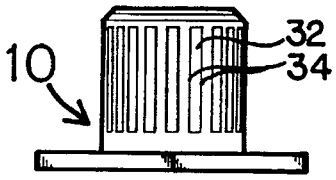
FIG. 5 is a side view of the insert of FIG. 2B.
Figure 6:
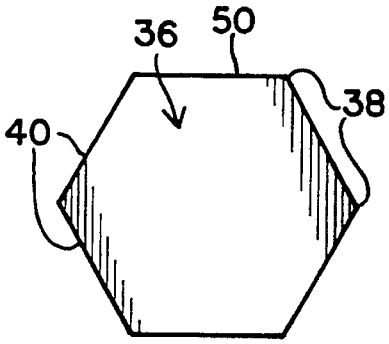
FIG. 6 is a bottom view of the insert of FIG. 2B.
Figure 7:
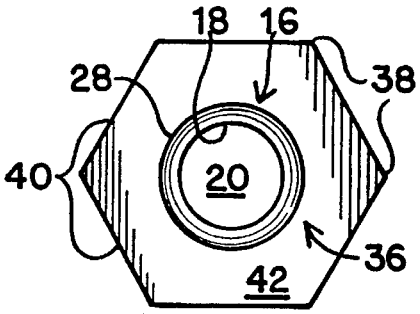
FIG. 7 is a top view of the insert of FIG. 2B.
Figure 8:
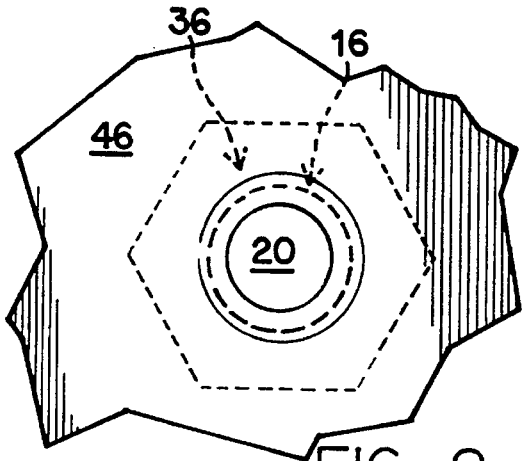
FIG. 8 is a top view of a portion of the snow board of FIG. 1 shown with the insert of FIG. 2B, in dashed lines, inserted into the snow board hole.

The insert 10 is installed in a similar manner to the standard inserts described in the Related Art section above. A two-diameter hole 12 is drilled through the board 14 from the board bottom surface 44 to the top surface 46, with the smaller diameter portion of the hole 12 being closer to the top surface 46. The smaller and larger diameters of the hole 12 are sized to be slightly larger than the outer diameter of the shaft 16 and the base 36, respectively. After inserting the insert 10 into the hole, as shown in FIG. 2B, cement 30 or other adhesive or filler is added to the hole 12 to harden around the base 36 and around the knurled exterior surface 28 of the shaft 16. The spaces 48 between the segments 40 and the hole 12 and the channels 32 fill with cement 30 to create a tight, secure, and more permanent installation than in the case of the prior art inserts. After cementing the insert 10 in place, P-Tex™ is applied to the board bottom surface 44 to create a smooth and flawless surface.

This and various embodiments of this installation procedure may be used to install the invented insert 10 into snow boards 14 both during manufacture and later in the life of the snow board, for repairs of failed prior art inserts and for installation of new holes in new locations on the board.

The most important feature of the non-round base 36 is that it provides a non-circular outer edge 50 for gripping against the cement 30. The corners 38 and segments 40 grip and push against the hardened cement 30 to prevent rotation even after repeated torque and use of the inserts 10. The hexagonal base 16 is an especially effective shape for the base, because if supplies several corners and flat segments for gripping the cement, while also creating a large and symmetrical surface of top ledge 42 for holding the insert 10 in the hole 12.

Other shapes of non-round base 16 may also be effective and are included in the disclosure of this invention. For example, a triangular, square, pentagonal, octagonal, or other corner-and-flat-segment shapes would be effective base shapes. Also, even a non-round but smooth shape such as an oval or figure-eight shape would supply the gripping feature for anchoring the base and therefore the insert in the cement. The hexagonal base 16 is chosen as the preferred base, however, because of the combination of ease of manufacture, gripping effectiveness, and large surface area of the top ledge 42.

The preferred insert 10 is made of 303 Stainless Steel and has a 0.2–0.4 inch outer diameter shaft 16 and a 0.75 inch diameter base 36, measured from corner to corner. The preferred cement 30 for installation is two-part epoxy.

The invented insert 10 is not limited to use with snow boards, but may be used with any recreational board, such as a ski, a sled, a toboggan, etc.. A recreational board is defined as a board that holds a person or part of a person for entertainment or sport, the recreational board having a bottom surface for contacting snow, water, carpet, or earth, etc., wherein it is important, for the sliding or motion of the board, that the bottom surface is smooth and uninterrupted by protruding bolt heads, nails, etc.

The term "cement" in the description and claims includes any adhesive, epoxy, or filler, wet or dry, that may be used to hold the insert in a hole. The term "binding screws", "screws", or "bolts" includes any threaded fastener that may be received into the insert. The term "generally cylindrical shaft" means that the insert interior surface is generally cylindrical for being threaded to receive screws or bolts, and that the insert exterior surface may be cylindrical but also may include texture, indentations, or protrusions that aid in gripping the cement around the shaft.

Although this invention has been described above with reference to particular means, materials, dimensions, and embodiments, it is to be understood that the invention is not limited to these disclosed particulars, but extends instead to all equivalents within the scope of the following claims.

I claim:

1. An insert for being imbedded in a snow board for receiving binding screws, the insert comprising:

a generally planar, non-round base, having an outer perimeter edge that is non-circular, and a hollow, generally cylindrical shaft extending perpendicularly from the said base, the shaft having an exterior surface having knurling, and an interior surface having threads and defining an interior space for receiving the binding screws.

2. An insert as set forth in claim 1, wherein the non-round base is hexagonal in shape.

3. An insert as set forth in claim 1, wherein the knurling on the exterior surface of the shaft comprises a plurality of vertical U-shaped channels cut into the exterior surface.

4. An insert as set forth in claim 3, wherein the non-round base is hexagonal in shape.

5. A binding attachment system for receiving binding screws, the system comprising:

a recreational board having a bottom surface and a top surface and a hole bored through the board from the bottom surface to the top surface, an insert received in the said hole, the insert comprising:

a generally planar, non-round base, having an outer perimeter edge that is non-circular, and a hollow, generally cylindrical shaft extending perpendicularly from the said base and extending toward the top surface of the recreational board, the shaft having an exterior surface and an interior surface having threads and defining an interior space for receiving the binding screws, and cement inside the hole and contacting the insert to fill the hole and to secure the insert in the hole.

6. A binding attachment system as set forth in claim 5, wherein the non-round base is hexagonal in shape.

7. A binding attachment system as set forth in claim 5, wherein the recreational board is a snow board.

8. A binding attachment system as set forth in claim 7, wherein the non-round base is hexagonal in shape.

9. A binding attachment system as set forth in claim 5, wherein the exterior surface of the shaft has knurling.

10. A binding attachment system as set forth in claim 9, wherein the knurling comprises a plurality of vertical U-shaped channels cut into the exterior surface.

11. An insert as set forth in claim 10, wherein the non-round base is hexagonal in shape.

* * * * *